US010966533B2

(12) United States Patent
Ciprian et al.

(10) Patent No.: US 10,966,533 B2
(45) Date of Patent: Apr. 6, 2021

(54) WASTE DISPOSAL SYSTEMS FOR HIGH DENSITY VENUES

(71) Applicant: SNAPBACK SEAT COMPANY LTD., Vancouver (CA)

(72) Inventors: Micah Ciprian, New Westminster (CA); Gavin Hamblin, Campbell River (CA)

(73) Assignee: SNAPBACK SEAT COMPANY LTD.

( * ) Notice: Subject to any disclaimer, the term of this patent is extended or adjusted under 35 U.S.C. 154(b) by 0 days.

(21) Appl. No.: 16/668,738

(22) Filed: Oct. 30, 2019

(65) Prior Publication Data

US 2020/0060426 A1 Feb. 27, 2020

Related U.S. Application Data

(63) Continuation of application No. 15/770,490, filed as application No. PCT/CA2017/050855 on Jul. 14, 2017, now Pat. No. 10,492,615.

(Continued)

(51) Int. Cl.

*A47C 7/62* (2006.01)
*E04H 3/30* (2006.01)

(Continued)

(52) U.S. Cl.

CPC ..... *A47C 7/628* (2018.08); *A47C 1/12* (2013.01); *A47C 7/56* (2013.01); *A47C 7/62* (2013.01); *B65F 1/0013* (2013.01); *E04H 3/30* (2013.01)

(58) Field of Classification Search

CPC .... A47C 7/62; A47C 7/56; A47C 1/12; B65F 1/0013; E04H 3/30

(Continued)

(56) References Cited

U.S. PATENT DOCUMENTS 1,829,486 A * 10/1931 Kimbrig ..... A47C 7/64 297/188.02
3,632,029 A * 1/1972 Sonner ..... B65F 1/002 224/275

(Continued)

FOREIGN PATENT DOCUMENTS

CN 2226879 Y 5/1996
CN 202051313 U 11/2011
CN 203142466 U 8/2013

OTHER PUBLICATIONS

International Search Report and Written Opinion for PCT/CA2017/050855, International Searching Authority, dated Oct. 24, 2017.

(Continued)

*Primary Examiner* — Justin V Lewis
(74) *Attorney, Agent, or Firm* — Dentons Canada LLP

(57) ABSTRACT

An apparatus for disposing waste at a seat comprising a seat body having a topside for supporting a user and an underside opposite to the topside. The apparatus comprises a moveable bottom portion mounted below the underside of the seat body on one or more arms configured to allow the moveable bottom portion to move between an open position and a closed position, a first waste bag support positioned below the underside of the seat body and a second waste bag support positioned on an upper side of the moveable bottom portion. Each arm comprises one or more springs for biasing the moveable bottom portion into the closed position.

6 Claims, 5 Drawing Sheets

Related U.S. Application Data

(60) Provisional application No. 62/495,442, filed on Sep. 15, 2016.

(51) Int. Cl.
*A47C 1/12* (2006.01)
*A47C 7/56* (2006.01)
*B65F 1/00* (2006.01)

(58) Field of Classification Search
USPC ..... 297/188.01, 188.02, 188.05, 188.08, 297/188.09, 188.1, 188.13, 188.15, 297/188.19, 200
See application file for complete search history.

(56) References Cited

U.S. PATENT DOCUMENTS

| | | | |
|---|---|---|---|
| 5,887,942 | A | 3/1999 | Allegro, Jr. |
| 5,927,800 | A | 7/1999 | Stallworth |
| 5,934,615 | A | 8/1999 | Treichler et al. |
| 6,053,570 | A | 4/2000 | Stern et al. |
| 6,161,896 | A | 12/2000 | Johnson et al. |
| 8,544,944 | B1 | 10/2013 | Gelley |
| 2005/0127725 | A1 | 6/2005 | Satani et al. |
| 2016/0129845 | A1 | 5/2016 | Kalergis et al. |
| 2016/0229537 | A1 | 8/2016 | Scown et al. |

OTHER PUBLICATIONS

Office Action issued in connection with U.S. Appl. No. 15/770,490, US Patent and Trademark Office, dated Jan. 2, 2019.
Final Office Action issued in connection with U.S. Appl. No. 15/770,490, US Patent and Trademark Office, dated Apr. 12, 2019.
Advisory Action issued in connection with U.S. Appl. No. 15/770,490, US Patent and Trademark Office, dated Jul. 2, 2019.

* cited by examiner

WASTE DISPOSAL SYSTEMS FOR HIGH DENSITY VENUES

CROSS REFERENCE TO RELATED APPLICATIONS

This application is a continuation of U.S. patent application Ser. No. 15/770,490 filed on Apr. 23, 2018 as a national phase entry under 35 U.S.C 371 of International Application No. PCT/CA2017/050855 filed Jul. 14, 2017, and claims the benefit of priority of U.S. Provisional Patent Application No. 62/495,442 filed on Sep. 15, 2016, all of which are hereby incorporated herein by reference in their entireties.

TECHNICAL FIELD

The present disclosure relates to disposal of waste in a high density venue. Example embodiments provide apparatus that allows the user to dispose of their waste at their seat.

BACKGROUND

In a high density venue, a user is typically forced to either exit the row and area they are sitting to dispose of their waste, or more commonly, litter the ground below their chair. This both causes discomfort for the user and creates an unsightly pile of debris that hampers the overall experience of the patron. This improperly disposed of waste also increases the cleaning and maintenance costs of the facility.

Most venues do not have an effective system for patrons to dispose of their waste while seated within the facility. Examples of prior art waste disposal systems include:

U.S. Pat. No. 5,887,942;

U.S. Pat. No. 5,927,800;

Chinese Utility Model No. CN 202051313 U;

Chinese Utility Model No. CN 203142466 U; and

Chinese Utility Model No. CN 2226879 Y.

The inventors have determined a need to for effective solutions that allow patrons to dispose of their waste at their seats while both increasing user experience and decreasing facility costs associated with improperly disposed of waste.

SUMMARY

One aspect of the present disclosure provides an apparatus for disposing waste at a seat comprising a seat body having a topside for supporting a user and an underside opposite to the topside. The apparatus comprises a moveable bottom portion mounted below the underside of the seat body on one or more arms configured to allow the moveable bottom portion to move between an open position and a closed position, a first waste bag support positioned below the underside of the seat body and a second waste bag support positioned on an upper side of the moveable bottom portion. Each arm comprises one or more springs for biasing the moveable bottom portion into the closed position.

Further aspects and details of example embodiments are set forth below.

DRAWINGS

The following figures set forth embodiments in which like reference numerals denote like parts. Embodiments are illustrated by way of example and not by way of limitation in the accompanying figures.

DETAILED DESCRIPTION

Figure 1:
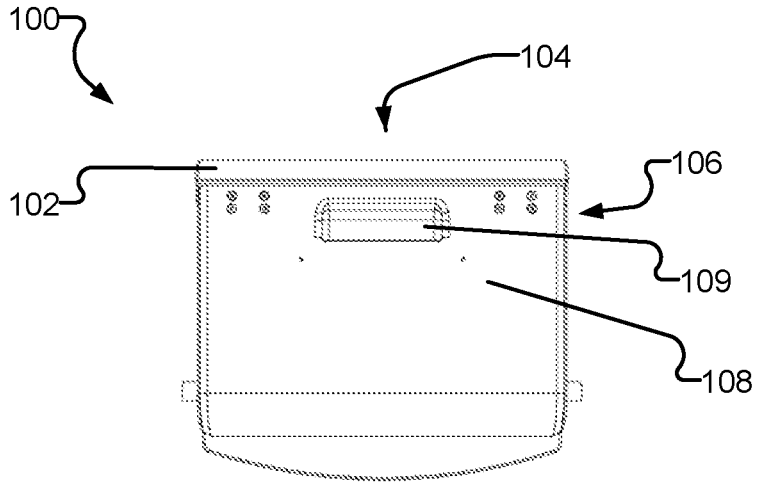
FIG. 1 shows a foldable seat in a vertical position incorporating a waste disposal apparatus according to one embodiment of the present disclosure. The waste disposal apparatus is completely concealed so that only the bottom portion of the seat is showing.

The following describes example apparatus for waste disposal in a high density venue. In some embodiments, the apparatus is easily used when the patron is either sitting in the folding seat or standing next to the folding seat. In some embodiments, the apparatus blends seamlessly into the seat bottom. In some embodiments, the apparatus accommodates an easily removable bag for disposal of waste. In the examples discussed below, the apparatus is incorporated into the seat bottom of a folding seat and configured such that when the folding seat is in a vertical position, the apparatus for waste disposal is only noticeable when waste is inside.

For simplicity and clarity of illustration, reference numerals may be repeated among the figures to indicate corresponding or analogous elements. Numerous details are set forth to provide an understanding of the examples described herein. The examples may be practiced without these details. In other instances, well-known methods, procedures, and components are not described in detail to avoid obscuring the examples described. The description is not to be considered as limited to the scope of the examples described herein.

Figure 2:
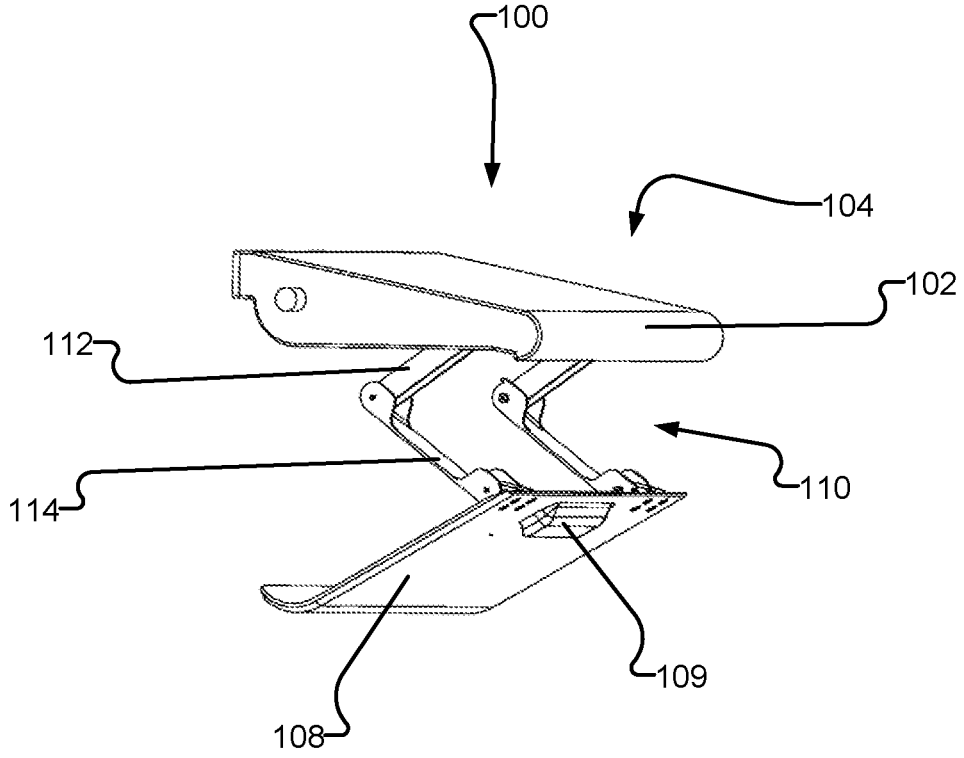
FIG. 2 shows the foldable seat of FIG. 1 in a horizontal position wherein the waste disposal apparatus is open and ready to accept waste.

FIGS. 1 and 2 show an example waste disposal apparatus 100 in the form of a seat bottom for a folding seat such as found in an arena, stadium, theater, or the like, according to one embodiment of the present disclosure. The apparatus 100 comprises a seat body 102 having a topside 104 for supporting a user and an underside 106. The underside 106 comprises a moveable bottom portion 108 that can be pulled away from the seat body 102 to provide access to a waste bag, as discussed below. In some embodiments the moveable bottom portion 108 comprises a handle 109 to facilitate operation by a user. The apparatus is moveable between a closed position wherein the apparatus appears to be a standard seat bottom, as shown in FIG. 1, and an open position, as shown in FIG. 2.

Apparatus 100 comprises a pair of arms 110 pivotally coupled between the moveable bottom portion 108 and the seat body 102, with one arm 110 on each of the left and right sides of the apparatus. In the illustrated example, each arm 110 comprises an upper segment 112 pivotally coupled to the seat body 102 and a lower segment 114 pivotally coupled to the moveable bottom portion 108. Details of an example arm 110 are described below.

In the illustrated example, the arms 110 are configured to bias the waste disposal apparatus 100 toward the closed position, and a locking mechanism is provided to hold the apparatus open for bag installation, removal and replacement as discussed below. In other embodiments, the arms may bias the apparatus into the open position and a locking mechanism may be provided to hold the apparatus closed, or the arms may not provide any biasing force such that the apparatus must be manually moved between the closed and open positions.

Figure 3:
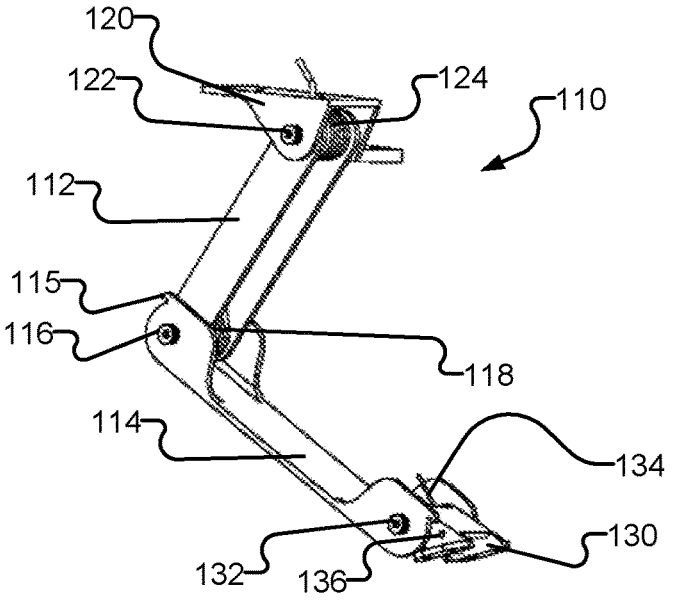
FIG. 3 shows an example arm of a waste disposal apparatus according to one embodiment of the present disclosure.
Figure 3A:
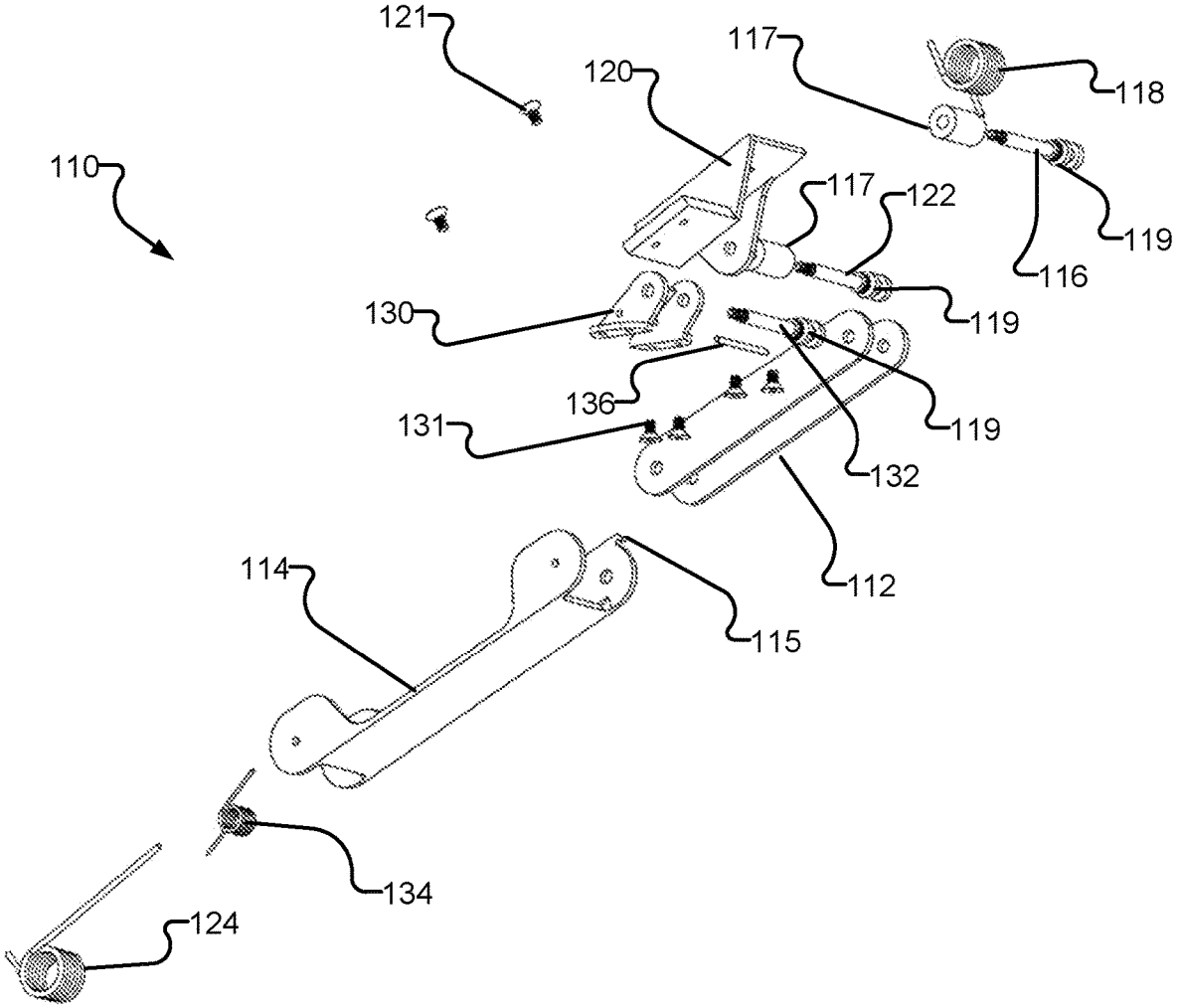
FIG. 3A is an exploded view of the arm of FIG. 3.

Details of an example arm 110 are shown in FIGS. 3 and 3A. The upper segment 112 is pivotally coupled to the lower segment 114 by a central pivot 116. A central spring 118 biases the upper and lower segments 112 and 114 to rotate toward each other about the central pivot 116. The upper segment 112 is pivotally coupled to an upper mounting bracket 120 by an upper pivot 122. The upper mounting bracket 120 is configured for mounting to the bottom of the seat body 102, or a base plate or other structure attached thereto, as discussed below. An upper spring 124 biases the upper segment 112 to rotate about the pivot 122 towards the bottom of the seat body 102. The lower segment 114 is pivotally coupled to lower mounting bracket 130 by a lower pivot 132. The lower mounting bracket 130 is configured for mounting to the top of the moveable bottom portion 108, as discussed below. A lower spring 134 biases the lower mounting bracket 130 (and thus the moveable bottom portion 108 when installed) to rotate about the pivot 132 towards the lower segment 114. In some embodiments, the lower spring 134 exerts less force than the upper or central springs. In some embodiments, the lower segment 114 comprises a protrusion 115 extending from one end thereof for holding the arm 110 in a locked open position, as described below. In some embodiments the lower segment 114 may have protrusions 115 on both ends, such that the lower segment 114 for each of the left side arm 110 and the right side arm 110 may be identical to minimize the number of unique components. The pivots 116, 122, 132 may each, for example, comprise a screw, bolt, pin or the like. Bobbins 117 and/or spacers 119 may maintain desired spacing between pivots 118/122/132, springs 118/124/134 and segments/brackets 112/114/120/130. A dowel pin 136 limits the rotation of the lower mounting bracket 130.

Figure 6:
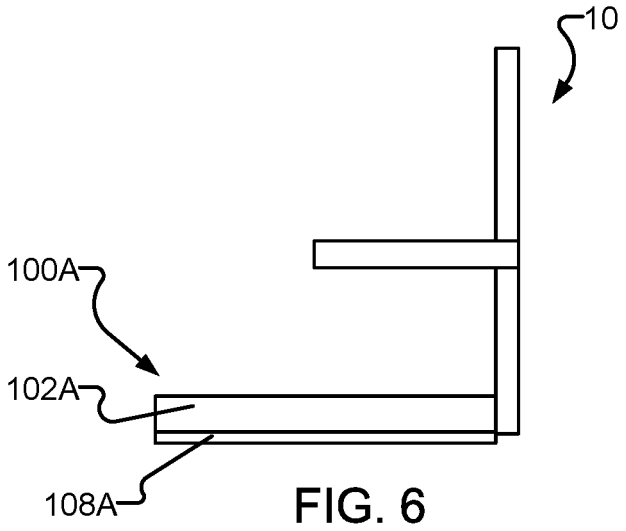
FIG. 6 shows a foldable seat incorporating a waste disposal apparatus according to another embodiment of the present disclosure in a horizontal position.
Figure 6A:
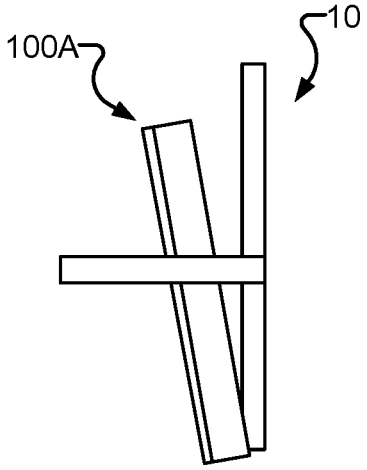
FIG. 6A shows the foldable seat of FIG. 6 in a vertical position.
Figure 6B:
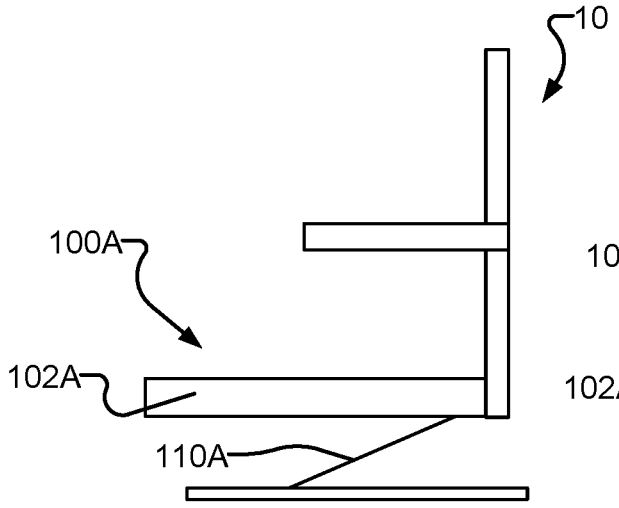
FIGS. 6B and 6C show the foldable seat of FIG. 6 with alternative embodiments of the arms.
Figure 6C:
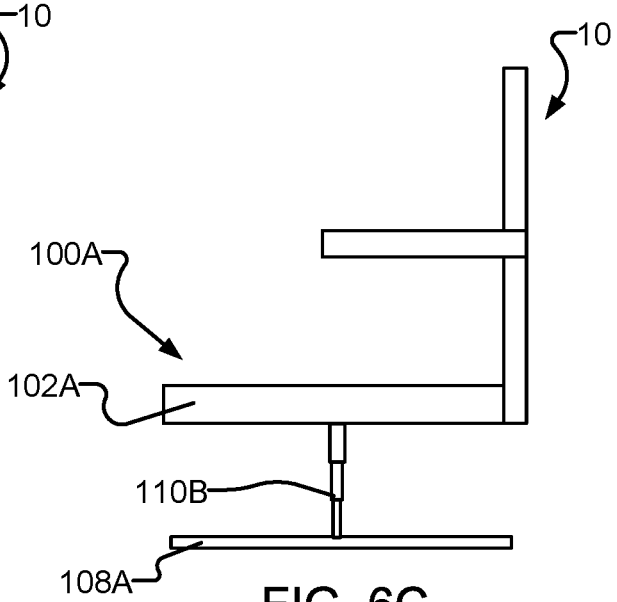

The apparatus 100 may have one or more arms with different configurations than the examples discussed above in other embodiments. For example, in some embodiments each arm may comprise only one segment pivotally connected between the bottom of the seat body and the top of the moveable bottom portion, or more than two segments. FIGS. 6 and 6A schematically depict a stadium seat 10 with a foldable seat bottom 100A comprising a seat body 102A and a moveable bottom portion 108A according to one embodiment. In some embodiments, only one arm 110A is connected between the moveable bottom portion 108A to the seat body 102A, as shown in FIG. 6B. In some embodiments, a single telescoping arm 110B is connected between the moveable bottom portion 108A to the seat body 102A as shown in FIG. 6C. In some embodiments, a combination of one or more pivotable arms and one or more telescoping arms may be connected between the moveable bottom portion 108A to the seat body 102A.

Figure 4:
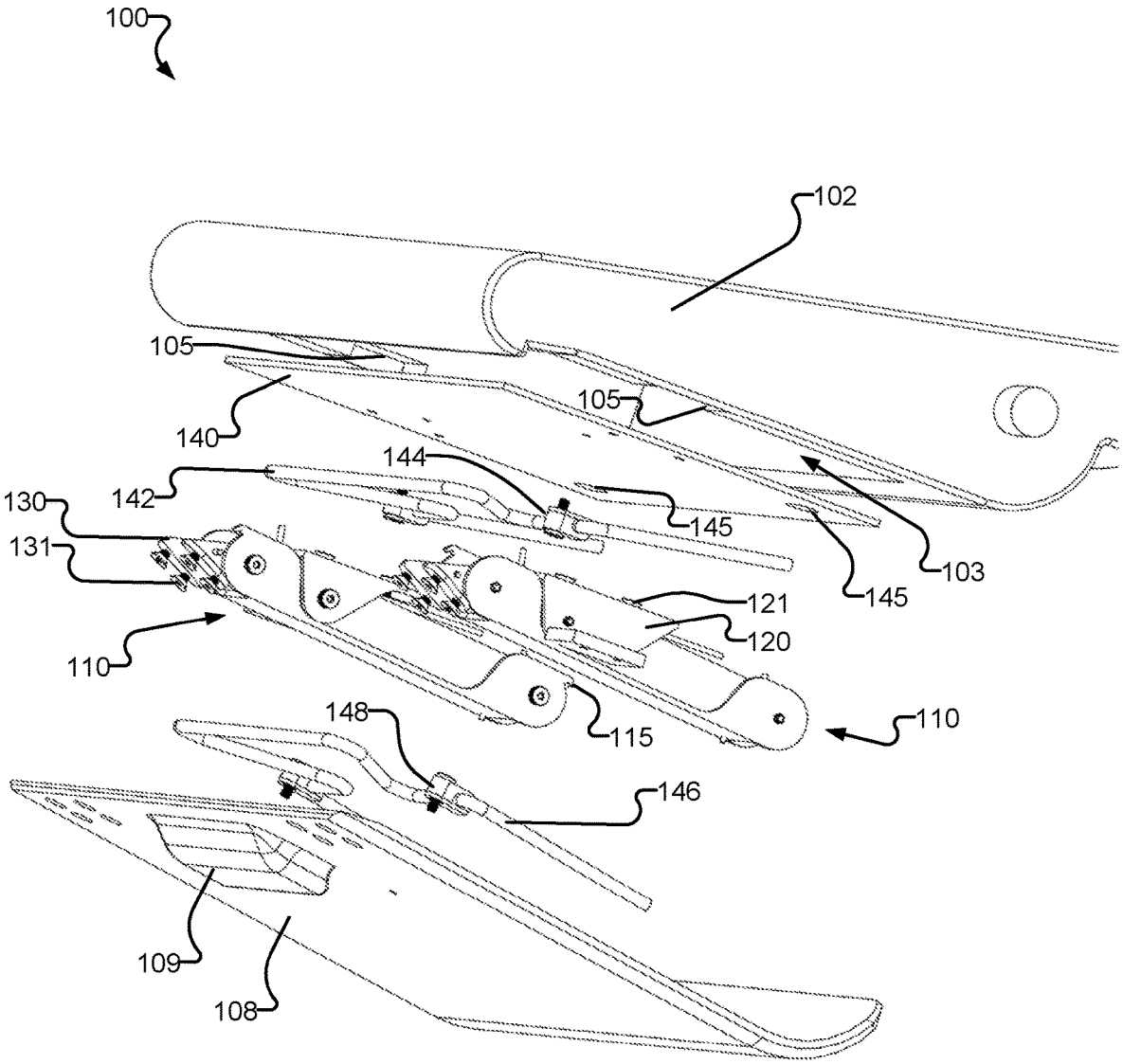
FIG. 4 shows an exploded view of the foldable seat of FIG. 1.

FIG. 4 shows an exploded view of the example apparatus 100 of FIGS. 1 to 3. The seat body 102 has a bottom shaped to conform to the shape of the moveable bottom portion 108, and has a cavity 103 for concealing the arms 110 when the apparatus is closed. The moveable bottom portion 108 is likewise shaped to conform to a shape of the underside of the seat body 102 such that the apparatus is concealed when the moveable bottom portion is in the closed position, such that the seat appears like a regular seat without any waste disposal apparatus. In the illustrated example, the pair of arms 110 are mounted on a base plate 140 for installation into the cavity 103, but in other embodiments arms may be mounted directly to the seat body 102. The lower mounting brackets 120 are secured to the base plate 140 by short screws 121 or the like. The lower mounting brackets 120 are also secured to the seat body 102 by longer screws or bolts (not shown). The seat body 102 defines notches 105 on either side of the cavity 103 sized to receive laterally extending flange portions of the lower mounting brackets 120. The upper mounting brackets 130 are secured to the bottom portion 108 by short screws 131 or the like.

A first waste bag support 142 in the form of a wire frame is mounted on the base plate 140 by tube clamps 144. A second waste bag support 146 in the form of another wire frame is mounted on the moveable bottom portion 108 by tube clamps 148. Waste bag supports 142 and 146 may be differently configured in alternative embodiments. For example, in the illustrated example the waste bag supports 142 and 146 are fixedly mounted, but in other embodiments one or both waste bag supports may be mounted by a spring-loaded mechanism to clamp bags between the supports and the bottom portion 108/base plate 140/seat bottom 102. In some embodiments, the waste bag supports may comprise hooks, tabs, clips or other bag holding means.

Figure 6D:
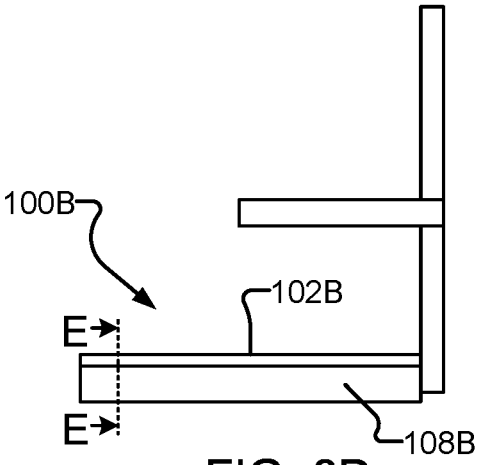
FIG. 6D shows a foldable seat incorporating a waste disposal apparatus according to another embodiment of the present disclosure in a horizontal position.
Figure 6E:
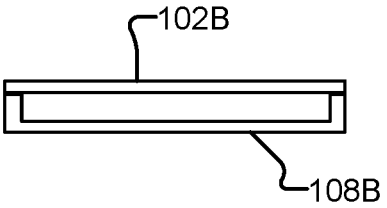
FIG. 6E is a sectional view taken along line E-E of FIG. 6D.

In the illustrated example, the seat bottom 102 defines a cavity for concealing the arms 110, but the apparatus may be differently configured in other embodiments. For example, FIGS. 6D and 6E schematically depict a foldable seat bottom 100A comprising a seat body 102B and a moveable bottom portion 108B wherein the underside of the seat body 1026 is flat and the moveable bottom portion 1086 contains a cavity.

Figure 5:
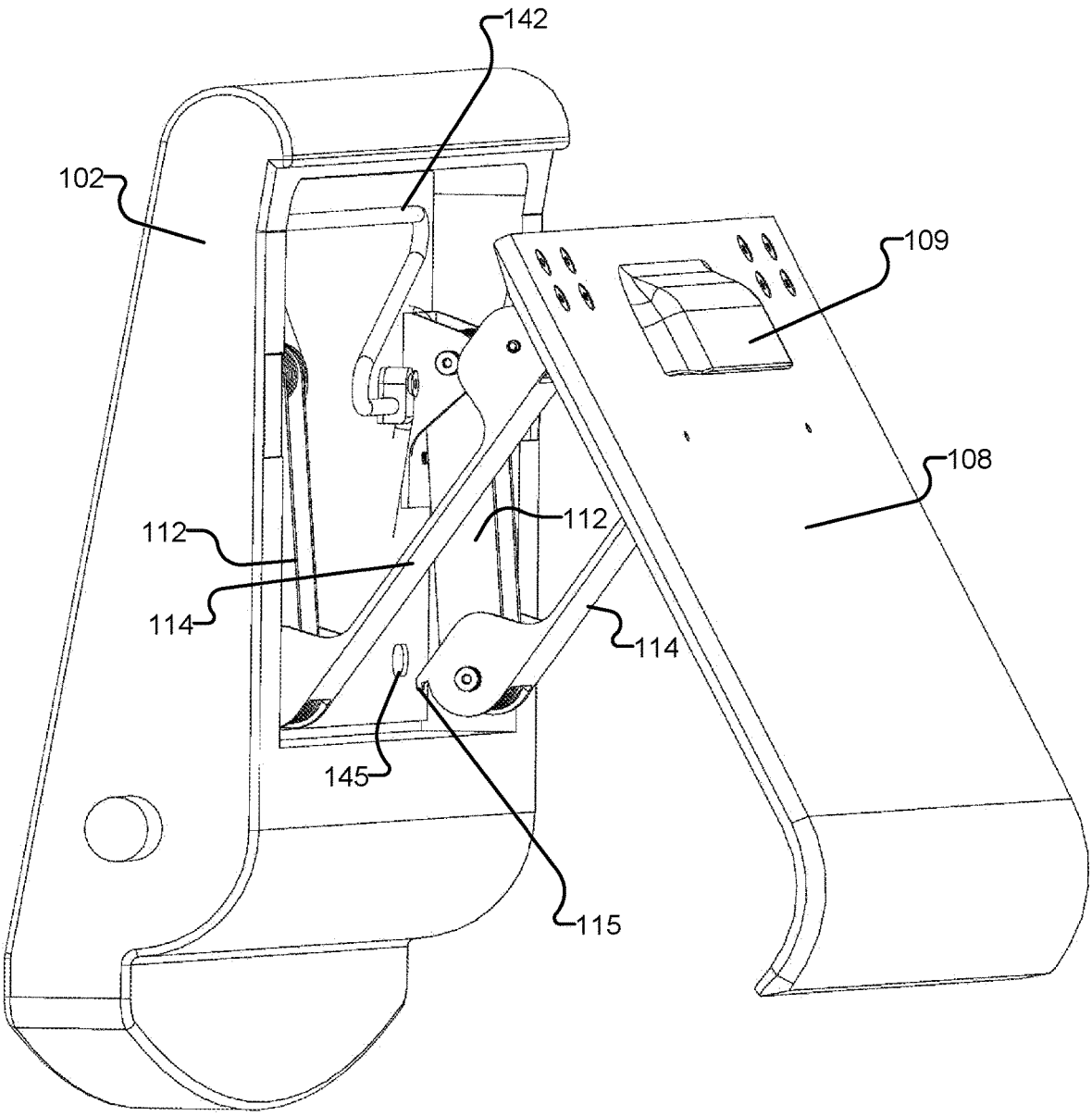
FIG. 5 shows the folding seat of FIG. 1 in the vertical position with the waste disposal apparatus in a locked open position.

In the illustrated example, the arms 110 are configured to bias the waste disposal apparatus 100 toward the closed position, and the apparatus 110 comprises a locking mechanism for holding the apparatus 100 in an open position. As best seen in FIGS. 4 and 5, the base plate 140 has a pair of holes 145 therein that may be engaged by the protrusions 115 of the lower segments 114 of the arms 110 to hold the waste disposal apparatus 100 in a locked open position. In operation, in order to lock the waste disposal apparatus 100, a user pulls the moveable bottom portion 108 away and downward (when the seat body 102 is in the vertical position) from the seat body 102, such that the upper segments 112 remain next to the base plate 140. As the moveable bottom portion 108 moves, the lower segments 114 rotate until the protrusions 115 engage the holes 145 in the base plate 140, thereby locking the lower segments 114 in an open position wherein the bottom portion 108 is away from the seat body 102, such that a waste bag (not shown) can be installed or removed from the waste bag supports 142 and 146. To unlock the waste disposal apparatus 100, a user pulls the moveable bottom portion 108 further away and upward from the seat bottom 102, such that the upper segments 112 move away from the base plate 140 and the protrusions 115 disengage from the holes 145 in the base plate 140, then releases the moveable bottom portion 108 such that the springs in the arms 110 return the moveable bottom portion 108 to the closed position shown in FIG. 1. FIG. 5 shows an example position of the apparatus 100 just after the protrusions 115 have disengaged from the holes 145.

The locking mechanism described above for keeping the moveable bottom portion in an open position may be different in alternative embodiments. For example, in some embodiments the arms 110 may be held in an open position through a ratchet locking mechanism, a kickstand-type locking mechanism, a slip-gear mechanism, or any other locking mechanism.

Some embodiments may provide waste disposal apparatus configured for mounting on existing seats, and methods of retrofitting existing venues with waste disposal apparatus according to any of the example embodiments or variations thereof described above. For example, a method according to one example comprises connecting a moveable bottom portion to the underside of a seat body by means of one or more arms and mounting a first waste bag support on the bottom of the seat body and a second waste bag support on the top of the moveable bottom portion. In some embodiments, the method may comprise forming a cavity in the underside of the seat body sized to accommodate the one or more arms such that when the moveable bottom portion is in a closed position the moveable bottom portion abuts the seat body around the cavity. In some embodiments, the moveable bottom portion defines a cavity sized to accommodate the one or more arms such that when the moveable seat bottom is in a closed position the seat body abuts the moveable bottom portion around the cavity.

The present disclosure may be embodied in other specific forms without departing from its spirit or essential characteristics. The described embodiments are to be considered in all respects only as illustrative and not restrictive.

The invention claimed is:

1. An apparatus for disposing waste at a seat comprising a seat body having a topside for supporting a user and an underside opposite to the topside, the apparatus comprising:

a moveable bottom portion mounted below the underside of the seat body, the moveable bottom portion mounted on one or more arms configured to allow the moveable bottom portion to move between an open position and a closed position;

a first waste bag support positioned below the underside of the seat body and a second waste bag support positioned on an upper side of the moveable bottom portion;

wherein each arm comprises one or more springs for biasing the moveable bottom portion into the closed position.

2. An apparatus according to claim 1 comprising a locking mechanism for keeping the moveable bottom portion in an open position.

3. An apparatus according to claim 2 wherein the one or more arms comprise a pair of arms.

4. An apparatus according to claim 3 wherein each arm comprises a lower segment and an upper segment each having a first end and a second end, with the first end of the upper segment pivotally coupled to the second end of the lower segment by a central pivot.

5. An apparatus according to claim 4 wherein each arm comprises a central torsion spring mounted on the central pivot.

6. A method for adapting a seat for waste disposal, the seat comprising a seat body having a topside for supporting a user and an underside opposite to the topside, the method comprising:

mounting a moveable bottom portion below the underside of the seat body by means of one or more arms configured to allow the moveable bottom portion to move between an open position and a closed position, wherein each arm comprises one or more springs for biasing the moveable bottom portion into the closed position;

mounting a first waste bag support below the underside of the seat body; and mounting a second waste bag support on an upper side of the moveable bottom portion.

* * * * *